US005921598A

United States Patent [19]

Bredow

[11] Patent Number: 5,921,598

[45] Date of Patent: Jul. 13, 1999

[54] GOLF BALL RETRIEVER

[76] Inventor: Edward F. Bredow, 285 Gull Dr., S, Daytona Beach, Fla. 32119

[21] Appl. No.: 08/862,397

[22] Filed: May 24, 1997

Related U.S. Application Data

[51] Int. Cl.[6] ..... A63B 47/02

[52] U.S. Cl. ..... 294/19.2

[58] Field of Search ..... 294/19.1, 19.2, 294/55, 66.1; 473/286

[56] References Cited

U.S. PATENT DOCUMENTS

| | | | |
|---|---|---|---|
| D. 187,600 | 4/1960 | Feiker | D34/5 |
| D. 205,526 | 8/1966 | Lehman | D34/5 |
| D. 216,138 | 11/1969 | Carignan | 473/286 |
| D. 283,432 | 4/1986 | Rosenow | D21/206 |
| D. 306,918 | 3/1990 | Carlson | D21/206 |
| D. 349,739 | 8/1994 | Kahl, Jr. | D21/206 |
| D. 362,038 | 9/1995 | Schatz | D21/206 |
| 1,523,270 | 1/1925 | Middleton | 294/19.2 |
| 1,960,110 | 5/1934 | Iles | 294/19.2 |
| 2,213,190 | 9/1940 | Haverbach | 294/19.2 |
| 2,270,632 | 1/1942 | Hasty | 294/19.2 |
| 2,523,942 | 9/1950 | Ciambriello | 294/19.2 |
| 2,814,520 | 11/1957 | Rubland | 294/19 |
| 3,442,544 | 5/1969 | Faber | 294/19.2 |
| 3,520,569 | 7/1970 | Anderson | 294/19.2 |
| 3,669,427 | 6/1972 | Curtis | 294/19.2 |
| 4,730,859 | 3/1988 | Gabinet | 294/19.2 |
| 5,110,168 | 5/1992 | Petrillo | 294/19.2 |
| 5,188,409 | 2/1993 | Forey | 294/19.2 |
| 5,368,352 | 11/1994 | Juhas | 294/19.2 |
| 5,423,584 | 6/1995 | Pasternak | 294/19.2 |
| 5,437,487 | 8/1995 | Fulop | 294/19.2 |
| 5,464,262 | 11/1995 | Madrazo | 294/19.2 |
| 5,513,884 | 5/1996 | Bucher | 294/19.2 |
| 5,662,366 | 9/1997 | Fraske | 294/19.2 |

FOREIGN PATENT DOCUMENTS

| | | | |
|---|---|---|---|
| 2074926 | 11/1981 | United Kingdom | 294/19.2 |

*Primary Examiner*—Dean Kramer

*Attorney, Agent, or Firm*—Brian S. Steinberger; Law Offices of Brian Steinberger

[57] ABSTRACT

A golf ball retriever device for allowing players to retrieve golf balls without having to stoop over. The device has a handle whose length varies by having telescoping sections. One end of the handle attaches to a cylindrical head section and the other end is for being gripped by the user. The axis of the handle is substantially parallel but slightly off-axis to the axis of the cylindrical head section. The cylindrical head section has a hollowed out interior with diameters greater than that of a traditional golf ball. The interior of the cylindrical head resembles the exterior of a bell wherein the inlet opening is funnel shaped and the rear interior has a lip formed from a concave rounded back edge and a through-hole in the backwall, the latter of which is smaller than the golf ball diameter. The interior of the cylindrical head adequately holds one, two, three or more golf balls stacked on one another. Another embodiment uses an elliptical head with similar attributes. The heads can have a bright yellow color to for enhanced visibility when using the retrievers in water traps. The device can easily be stored in a golf bag taking up no more room than a normal club.

16 Claims, 5 Drawing Sheets

GOLF BALL RETRIEVER

This invention relates to golf, and in particular to novel hollow scooping devices with off-axis longitudinal handles for picking up golf balls.

BACKGROUND AND PRIOR ART

Playing golf often requires the player having to continuously retrieve golf balls. Often players using golf carts require the player to get out of the cart and then bend and stoop over to retrieve the golf ball. The problem is compounded when the golf balls are lost in sand traps, water traps such as ponds, woods, weeds, vegetation and the like. In these situations, the golfer has to then put their hands into areas where it may not be safe to do so.

Devices have been proposed to help retrieve golf balls by players. See U.S. Pat. Nos.: Des.187,600 to Feiker; Des.205,526 to Lehman; Des. 283,432 to Rosenow; Des. 362,038 to Schatz; Des.349,739 to Kahl, Jr.; Des.360,918 to Carlson; 2,814,520 to Ruhland; 4,730,859 to Gabinet; 5,110,168 to Petrillo; 5,188,409 to Forey; 5,423,584 to Pasternak; 5,437,487 to Fulop; and 5,464,262 to Madrazo.

However, many of these devices require the user to apply pressure over the golf ball itself in order to trap the ball within a cage structure. Clearly, one cannot retrieve golf balls from ponds or the like having soft bottoms and sediment. Many of these basket and rake devices are large and cumbersome contraptions that are both difficult to maneuver as well as heavy to use. Still furthermore, many of the prior art devices are either or both complex and expensive to manufacture. Also many of these devices require the user balance the ball within the retriever itself causing problems of having the ball fall out of the retriever. Still furthermore, many of the prior art devices are difficult to carry around and are not easily adaptable to be used with golf bags and the like. And still furthermore, many of these devices cannot be used to retrieve more than one golf ball at a time.

Thus, the need exists for a golf ball retriever that avoids the problems in the prior art

SUMMARY OF THE INVENTION

The first objective of the present invention is to provide a golf ball retriever that allows a user to retrieve golf balls without bending and stooping over.

The second object of this invention is to provide a golf ball retriever that allows a user to scoop up lost golf balls in hard to reach areas.

The third object of this invention is to provide a golf ball retriever that will take up no more space in a golf bag than a golf club.

The fourth object of this invention is to provide a golf ball retriever that can retrieve plural balls in series adjacent one another.

The fifth object of this invention is to provide a golf ball retriever having a yellow head portion that is visible in murky water that aids in retrieving golf balls.

A preferred embodiment of the golf ball retriever device includes a tubular means having a funnel section with a larger opening than an interior opening, the larger opening facing outward, the larger opening and the interior opening both being larger than a diameter of a golf ball, the tubular means having a cup section with an open end at a rear end, the open end facing the interior opening of the funnel section. The funnel section has a length of approximately one inch with an outer end opening of approximately 2 ⅛ inches and an inner end opening of approximately 1 ⅞ inches. The cup section has a substantially uniform hollow interior diameter of approximately 1 ⅞ inches which is larger than the diameter of the golf ball, a length of approximately 1 inch and the rear end of the cup section has a lip formed from an interior concave rounded edge and a back through-hole therebetween of approximately 1 ⅜ inches which is smaller than the diameter of the golf ball. The retriever further includes a longitudinal handle with telescoping sections having one end attached to the tubular means, the axis of the tubular means and the axis of the longitudinal handle being substantially parallel to one another, the longitudinal handle having a second opposite end for being held by a user, wherein the user can scoop the golf ball by the funnel shaped opening of the tubular means. The cup section can have an attachment section that allows the longitudinal handle to angle away approximately 5 to approximately 15 degrees from the cup section. Alternatively, the longitudinal handle can have a slight bend of approximately 5 to approximately 15 degrees adjacent to the tubular means in the cup section so that the handle end angles away from the tubular means. A second embodiment has a longer length in the cup section of approximately 2 to approximately 4 inches for allowing plural golf balls to be retrieved and stacked therein. Another embodiment uses a retriever head having a elliptical shape with similar interior lip.

The golf ball retriever components can be formed from molded plastic, fiberglass, aluminium, galvanized metal, combinations thereof, and the like. Furthermore, the novel golf ball retriever device allows a player to stay in their golf cart and retrieve golf balls from a sitting position.

Further objects and advantages of this invention will be apparent from the following detailed description of a presently preferred embodiment which is illustrated schematically in the accompanying drawings.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1A:
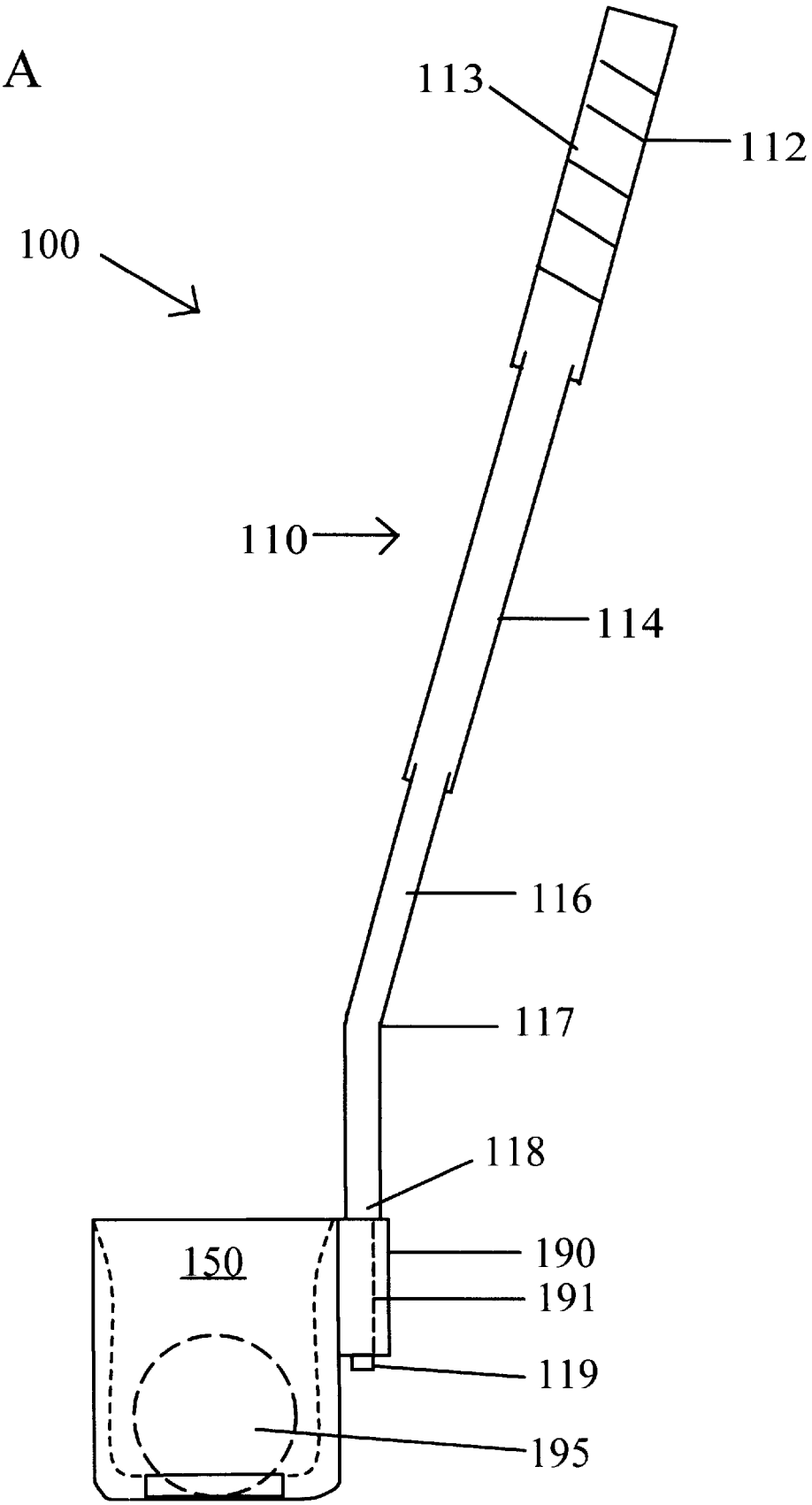
FIG. 1A is a perspective view of the novel golf ball retriever with a golf ball held therein.

FIG. 1A is a perspective view of the novel golf ball retriever 100 with a golf ball 195 held therein. Retriever 100 includes a longitudinal handle 110 and a head portion 150.

The handle 110 has telescoping sections 112, 114, 116 that can allow the length of the handle to vary from approximately three foot to twenty feet or more. Adjacent to the head portion 150, a slight bend 117 of approximately 5 to approximately 15 degrees causes hand end 112 to bend away from head portion 150 allowing a better scooping action when the retriever 100 is being used. Handle end 112 can include a roughened exterior 113, a rubber covering and the like to better aid a user's grip. Interior hole 191 of connector socket 190 can have an approximately ⅜ inch diameter and a ½ degree taper so that tip 119 can be pushed and held in place therein. Alternatively, tip 119 can be slightly flattened so that tip tightly fits within hole 191. Handle 110 can be tubing formed from molded plastic, fiberglass, aluminium, galvanized metal, combinations thereof, and the like.

Figure 1C:
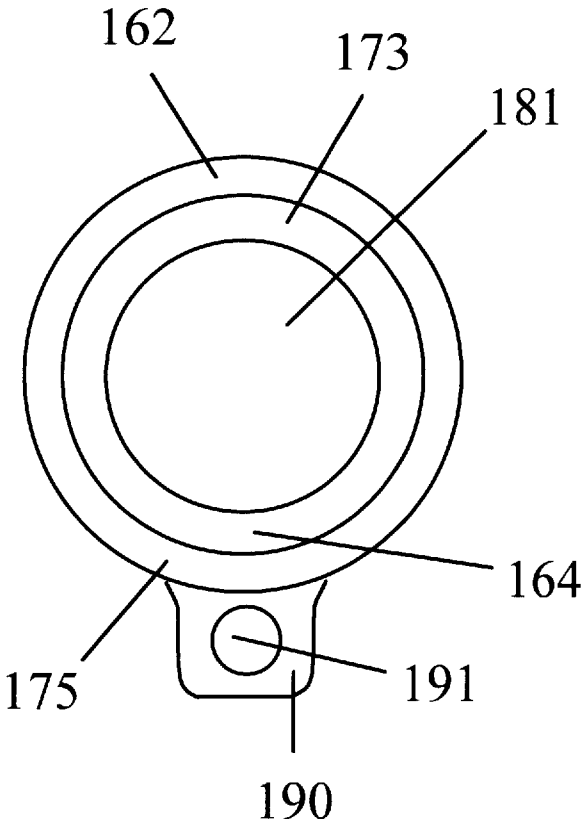
FIG. 1C is an end view of the head portion of the golf ball retriever of FIG. 1A along arrow A.
Figure 1B:
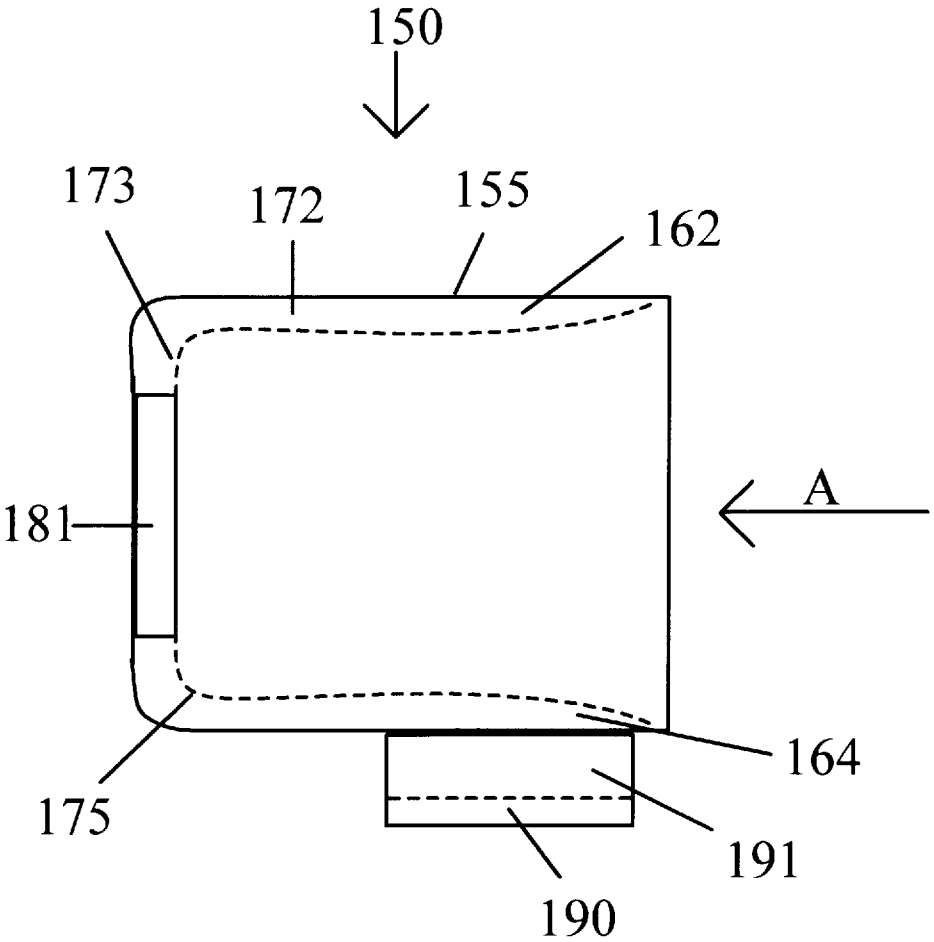
FIG. 1B is a cross-sectional view of the head portion of the novel golf ball retriever of FIG. 1A.

FIG. 1B is a side cross-sectional view of the head portion 150 of the novel golf ball retriever 100 of FIG. 1A. FIG. 1C is an end view of the head portion 150 of the golf ball retriever 100 of FIG. 1A along arrow A. Referring to FIGS. 1A–1C, head portion 150 has a substantially cylindrical exterior 155 with an outside diameter of approximately 2 ¼ inches and a length of approximately 2 inches. Head portion 150 has an outer opening 161 having a diameter of approximately 2 ⅛ inches and interior section 162, 164 forming a Funnel shape to an interior diameter 165 of approximately 1 ⅞ inches. It is important to note that a golf ball(195 FIG. 1)generally has a diameter of less than approximately 1 ⅞ inches.

Referring to FIGS. 1A–1C, the length of funnel section 162, 164 itself can be approximately 1 inches long. Head portion 150 includes a rear section having a cylindrical interior with a hollow interior diameter also of approximately 1 ⅞ inches. An interior concave rounded edge wall 173, 175 forms the back wall of the head portion and a through-hole 181 having a diameter of approximately 1 ⅜ inches is therebetween. It is important to note here the through-hole 181 has a diameter less than the diameter of a golf ball(195 of FIG. 1A). Interior edge walls 173, 175 form a lip that allows a portion of the golf ball to be suspended therefrom. The golf ball retriever head portion 150 can be formed from molded plastic, fiberglass, aluminium, galvanized metal, combinations thereof, and the like.

Figure 2:
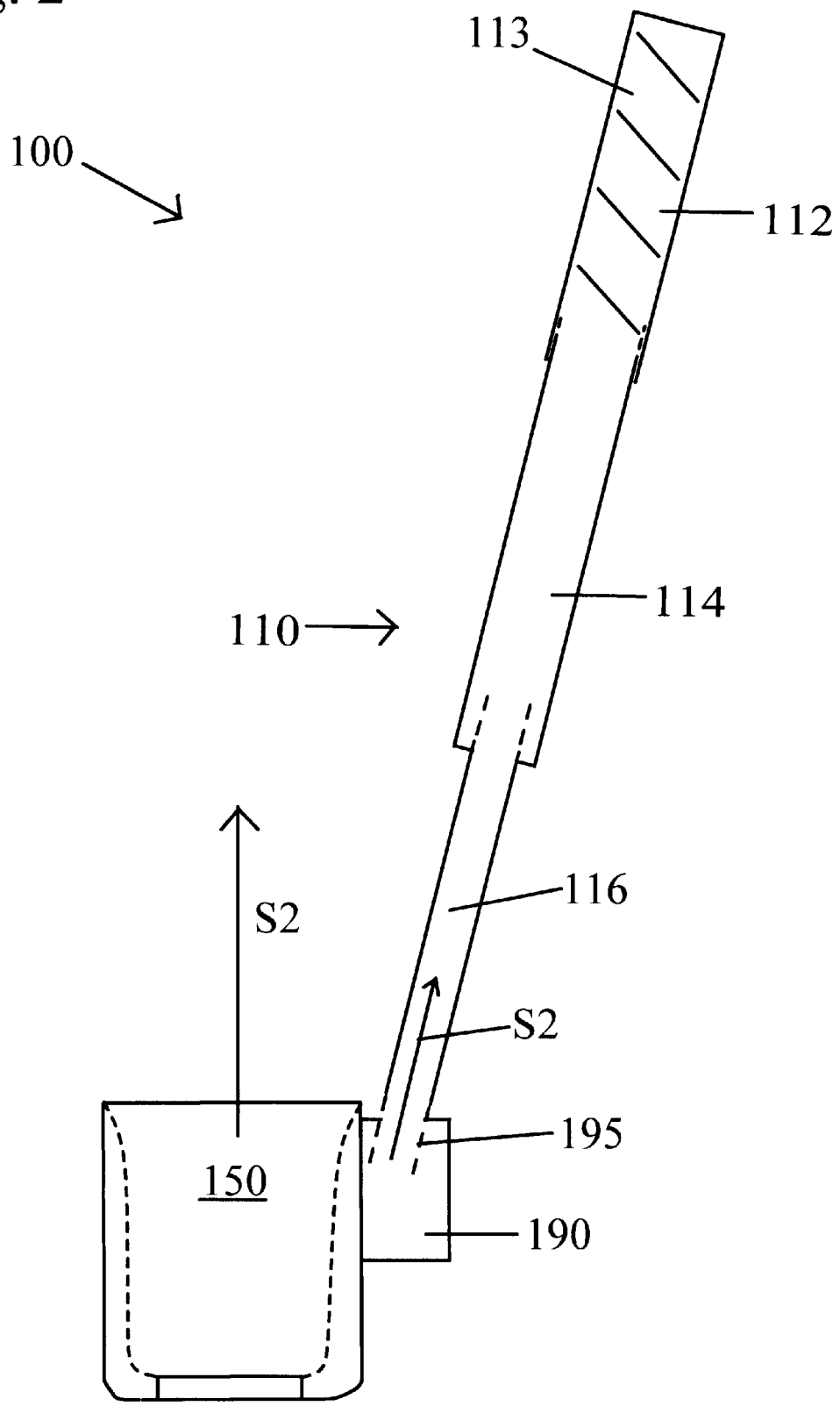
FIG. 2 is a perspective view of the retriever and and golf ball of FIG. 1A an off-axis handle mount.

FIG. 2 is a perspective view of the retriever 100' of FIG. 1A an off-axis handle mount. Referring to FIG. 2, all the components of the preceding figures are identical with the exception of connector socket 190. In this figure, interior hole 195 has an axis S1 which is off-axis at approximately 5 to approximately 15 degrees, as compared to axis S2 of headportion 150. Thus, longitudinal handle 110' unlike the preceding figures does not have a bend and relies on socket hole 195 to create the off-axis effect.

Figure 3:
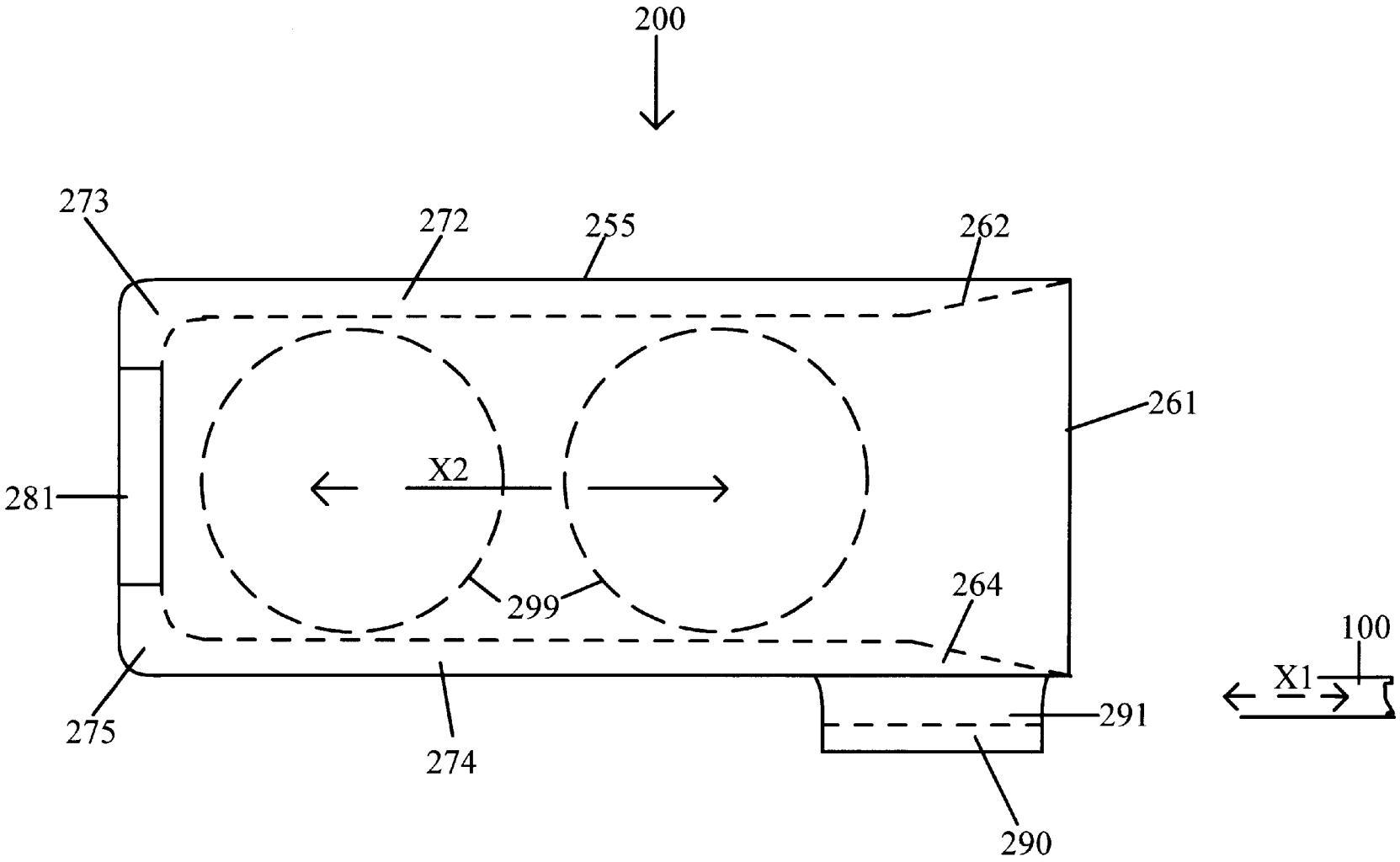
FIG. 3 shows a second embodiment of the head portion for use with the handle of FIG. 1A.

FIG. 3 shows a second embodiment 200 of the novel head portion for use with the longitudinal handle of FIG. 1. Opening 261, funnel sections 262, 264, socket connector 290 and socket opening 291, interior concave rounded edges 273, 275, and backwall hole 281 are substantially identical to the similarly labeled components of the preceding Figures. Socket mounting hole 291 can have an axis parallel to axis of cylindrical body 255 and use the longitudinal handle 110 of FIG. 1A. Alternatively, socket mounting hole 291 can have an off-axis as shown in FIG. 2 and use a straight longitudinal handle. In the embodiment 200, outer cylindrical body 255 has an overall length here of approximately 3 to approximately 5 inches and cup section walls 272, 274 have a length of approximately 2 to 4 inches. Thus, FIG. 3 allows a user to retrieve and hold plural golf balls 299 stacked one on another therein. From FIG. 3, it can be seen that the axis, X2, through the stacked golf balls 299 within the cylindrical head portion 200 is substantially parallel to the axis X1 of longitudinal handle 100.

Figure 4B:
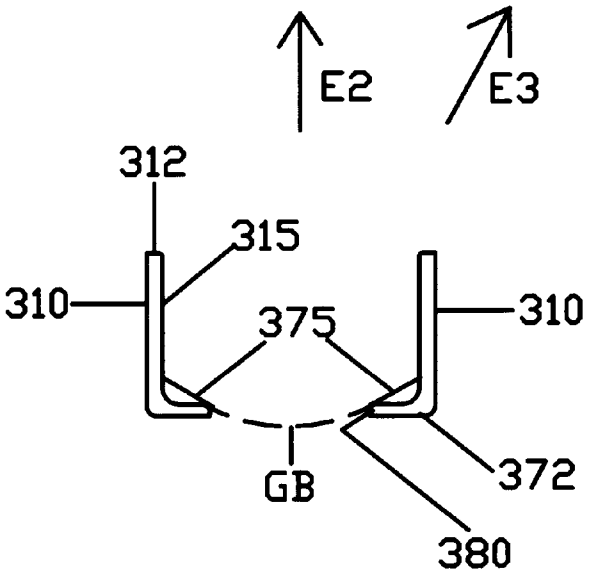
FIG. 4B is a cross-sectional view of the embodiment of FIG. 4A along arrow C.
Figure 4A:
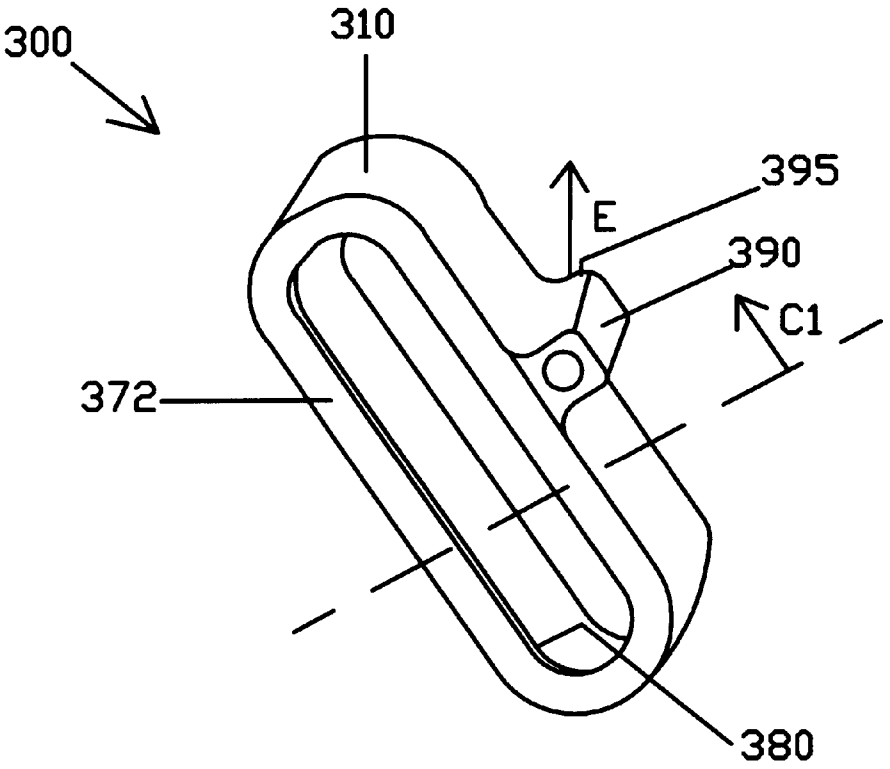
FIG. 4A is a perspective view of a third preferred embodiment of an elliptical shaped head portion.

FIG. 4A is a perspective view of a third preferred embodiment 300 of an elliptical shaped head portion. FIG. 4B is a cross-sectional view of the embodiment 300 of FIG. 4A along arrow C. Referring to FIGS. 4A–4B, embodiment 300 includes a hollow elliptical body 310, having interior walls 315 substantially parallel to outside walls 310. An exterior bottom edge portion 372 is substantially perpendicular to side walls 310 has an opening therethough 380 whose dimensions are slightly less than the diameter of a golf ball. An interior bottom edge portion 375 has a concave surface forming a gusset for allowing a golf ball(partially shown by broken lines GB) to be suspended and held within head portion 300. Socket connector 390 has a socket mounting hole 395 having an axis E1 parallel to axis E2 of cylindrical body 255 and use the longitudinal handle 110 of FIG. 1A. Alternatively, socket mounting hole 395 can have an off-axis E3 as shown in FIG. 2 and use a straight longitudinal handle.

The head portions shown in the above embodiments can be colored a bright reflective yellow color to allow the retrievers to be easily pulled from a golf bag. The yellow color of a headportion allows the retriever to be visible in murky water traps for maneuvering the retriever to retrieve golf balls.

All of the retriever embodiment components can be formed from molded plastic, fiberglass, aluminium, galvanized metal, combinations thereof, and the like.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A golf ball retriever device, comprising:

a cup means having a funnel shaped opening larger than a diameter of a golf ball, and a rear section having an interior facing lip forming a circular single diameter through-hole for substantially supporting the golf ball therein, the through-hole being less than the diameter of a golf ball, wherein the lip has an interior concave rounded edge across a backwall of the rear section, and an opening inside of the concave rounded edge smaller than the diameter of the golf ball; and a longitudinal handle having one end attached to the cup means and a second opposite end being held by a user, the axis of the handle being slightly off-axis to the axis of the cup means, wherein the user can scoop the golf ball by the funnel shaped opening of the cup means.

2. The golf ball retriever device of claim 1, wherein the funnel shaped opening includes:

a length of approximately one inch having an outer end opening of approximately 2 ⅛ inches and an inner end opening of approximately 1 ⅞ inches.

3. The golf ball retriever device of claim 1, wherein the rear section includes:

a cylindrical shape having a length of approximately 1 inch and interior diameter of approximately 1 ⅞ inches.

4. The golf ball retriever device of claim 3, wherein the through-hole includes:

an opening of approximately 1 ⅜ inches.

5. The golf ball retriever device of claim 1, wherein the cup means includes:

a socket connector having an opening for mounting the one end of the longitudinal handle therein, the opening being off-axis to the axis of the cup means by approximately 5 to approximately 15 degrees.

6. The golf ball retriever device of claim 1, wherein the longitudinal handle includes:

a bend of approximately 5 to approximately 15 degrees adjacent to the cup means.

7. The golf ball retriever device of claim 1, wherein the longitudinal handle includes: telescoping sections.

8. The golf ball retriever device of claim 1, wherein the rear section can hold plural balls stacked on one another.

9. A golf ball retriever device, comprising:

a catch means having a funnel section with a larger opening than an interior opening, the larger opening facing outward, the larger opening and the interior opening both being slightly larger than a diameter of a golf ball, the catch means having a cup section with an open end and a rear end, the open end facing the interior opening of the funnel section, the cup section having a substantially uniform hollow interior diameter larger than the diameter of the golf ball extending from the open end to the rear end, about the rear end is lip having a back through-hole smaller than the diameter of the golf ball for allowing a portion of the golf ball to be suspended therefrom; and a longitudinal handle having one end attached to a side of the cup section, the axis of the catch means and the axis of the longitudinal handle being off-axis to one another.

10. The golf ball retriever device of claim 9, wherein the funnel section includes:

a length of approximately one inch having an outer end opening of approximately 2 ⅛ inches and an inner end opening of approximately 1 ⅞ inches.

11. The golf ball retriever device of claim 9, wherein the cup section includes:

a cylindrical shape having a length of at least approximately 1 inch and continuous interior diameter of approximately 1 ⅞ inches.

12. The golf ball retriever device of claim 9, wherein the back through-hole includes:

an opening of approximately 1 ⅜ inches.

13. The golf ball retriever device of claim 9, wherein the lip includes:

an interior concave rounded edge across a backwall of the rear end; and an opening inside of the concave rounded edge smaller than the diameter of the golf ball.

14. The golf ball retriever device of claim 9, wherein the catch means includes:

a yellow color to allow the retriever visibility in water traps.

15. The golf ball retriever device of claim 14, wherein the cup section includes:

a cylindrical shape having a length of approximately 2 to approximately 4 inches and continuous interior diameter of approximately 1 ⅞ inches.

16. The golf ball retriever device of claim 15, wherein the funnel section includes:

a length of approximately one inch having an outer end opening of approximately 2 ⅛ inches and an inner end opening of approximately 1 ⅞ inches.

* * * * *